US005755019A

United States Patent [19]

Naka et al.

[11] Patent Number: 5,755,019

[45] Date of Patent: May 26, 1998

[54] PIEZOELECTRIC DRIVER FOR AN INK JET RECORDING HEAD, AND ITS MANUFACTURING METHOD

[75] Inventors: Takahiro Naka; Shinji Yasukawa; Minoru Usui, all of Nagano, Japan

[73] Assignee: Seiko Epson Corporation, Tokyo, Japan

[21] Appl. No.: 574,323

[22] Filed: Dec. 18, 1995

Related U.S. Application Data

[62] Division of Ser. No. 319,584, Oct. 7, 1994.

[30] Foreign Application Priority Data

| | | | |
|---|---|---|---|
| Oct. 7, 1993 | [JP] | Japan | 5-276171 |
| Dec. 27, 1993 | [JP] | Japan | 5-348532 |
| Jul. 20, 1994 | [JP] | Japan | 6-190012 |

[51] Int. Cl.[6] ..... H04R 17/00

[52] U.S. Cl. ..... 29/25.35

[58] Field of Search ..... 29/25.35; 310/330, 310/331, 332, 336, 358; 347/68–72, 94, 98

[56] References Cited

U.S. PATENT DOCUMENTS

| | | | |
|---|---|---|---|
| 4,409,601 | 10/1983 | Nilsson et al. | 346/140 R |
| 4,438,441 | 3/1984 | Bolmgren et al. | 346/140 R |
| 4,566,018 | 1/1986 | Nilsson | 346/140 R |

FOREIGN PATENT DOCUMENTS

| | | | |
|---|---|---|---|
| 0085599 | 8/1983 | European Pat. Off. | H01L 41/22 |
| 0443628A2 | 8/1991 | European Pat. Off. . | |
| 0516188 | 12/1992 | European Pat. Off. . | |
| 0550030 | 7/1993 | European Pat. Off. | B41J 2/025 |
| 0563603 | 10/1993 | European Pat. Off. . | |
| 584907 | 4/1993 | Japan . | |
| 5212861 | 8/1993 | Japan . | |

*Primary Examiner*—Carl E. Hall
*Assistant Examiner*—Christopher Goins
*Attorney, Agent, or Firm*—Sughrue, Mion, Zinn, Macpeak & Seas, PLLC

[57] ABSTRACT

In a piezo-electric driver for an ink jet recording head, conductive layers are laminated as an active region in a piezo-electric plate except the front and rear end portions thereof to provide front and rear inactive portions, a pressure facilitating front end plate and a vibrator coupling rear end plate are fixedly mounted on the front and rear inactive portions, respectively, and the front end portion of the piezo-electric plate together with the front end plate are cut at predetermined intervals into pieces, namely, piezo-electric units, which depress the vibrating boards of the ink jet recording head wide to cause the parallel displacement of the vibrating boards thereby effectively pressing the ink in the pressure chamber.

14 Claims, 12 Drawing Sheets

FIG. 3(a-1)
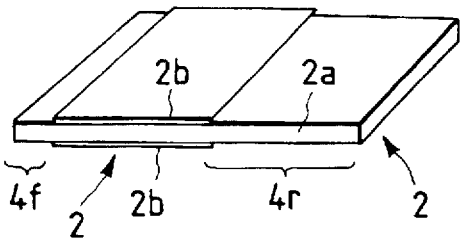
FIG. 3(a-2)
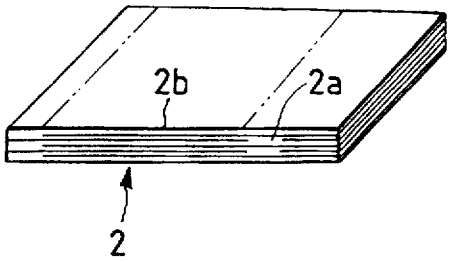
FIG. 3(b)
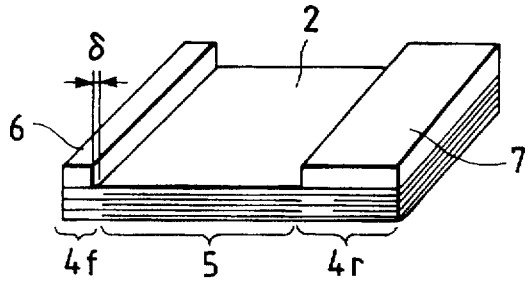
FIG. 3(c)
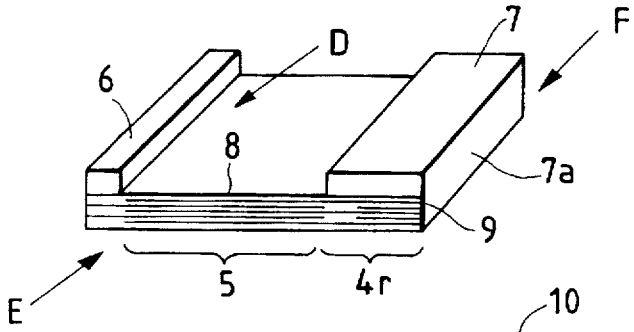
FIG. 3(d)
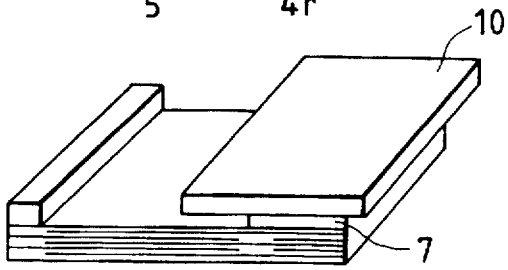
FIG. 3(e)
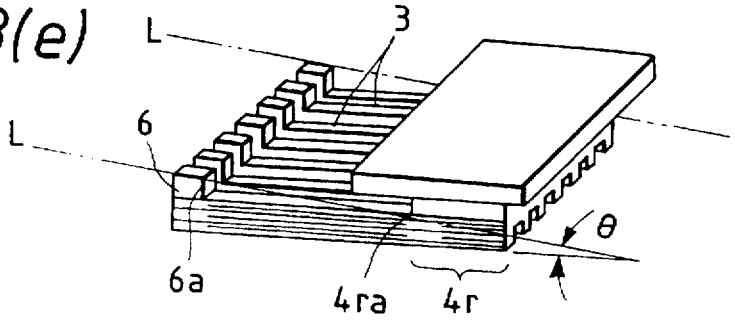

PIEZOELECTRIC DRIVER FOR AN INK JET RECORDING HEAD, AND ITS MANUFACTURING METHOD

This is a divisional of application Ser. No. 08/319,584 filed Oct. 7, 1994.

BACKGROUND OF THE INVENTION

1. Field of the Invention

This invention relates to a piezo-electric driver for an ink jet recording head, and a method of manufacturing the piezo-electric driver.

2. Description of the Prior Art

Japanese Patent Application (OPI) No. 1052/1992 (the term "OPI" as used herein means an "unexamined application") discloses an ink jet recording head of a vertical vibration mode comprising a nozzle plate having a plurality of nozzles, vibrating boards positioned behind the nozzle plate, piezo-electric vibrators of a vertical vibration mode small enough to match the nozzles abutted against the backs of the vibrating boards, and pressure chambers formed by the nozzle plate and the vibrating boards into which ink from an ink flow path flows. In the recording head, the piezo-electric vibrators are driven according to a given recording signal to pressurize the ink and to jet it in the form of ink droplets.

An ink jet recording head of this type is advantageous in that decreasing the size of the piezo-electric vibrators permits a decrease in the pitch of arrangement of the nozzles. However, in order to decrease the size of the piezo-electric vibrators, it is necessary to elongate each of the pressure chambers in the ink jetting direction to allow the latter to have an internal volume large enough to contain jet ink droplets. In addition, it is necessary to form annular grooves in the portions of the vibrating boards which confront with the peripheries of the pressure chambers, so that the portions thus thinned receive the small displacement of the piezo-electric vibrators with high efficiency.

The recording head may be modified to meet the above-described requirements; however, the effects of such a modification is limited. That is, if the island portion defined by the annular groove is longer than a certain value, then only the portion thereof which is in abutment with the piezo-electric vibrator is bent and the pressure that can be applied to the ink in the pressure chamber is limited.

SUMMARY OF THE INVENTION

In view of the foregoing, an object of the invention is to provide a novel piezo-electric driver for an ink jet recording head which has piezo-electric vibrators limited in displacement to pressurize the ink in the pressure chambers with high efficiency, and a method of readily manufacturing the piezo-electric driver with high accuracy.

The foregoing object of the invention has been achieved by the provision of:

(1) a piezo-electric driver for an ink jet recording head comprising, a piezo-electric plate having at least a front end portion as an inactive region, and another portion in which conductive layers are laminated, the piezo-electric plate is cut at predetermined intervals to form segments similar to teeth of a comb which form a plurality of piezo-electric vibrators, the front end portion of each of the piezo-electric vibrators is formed into the inactive portion, and a pressure facilitating front end plate is mounted on at least one surface of the inactive region in such a manner that the front end face thereof is flush with the outer end face of each piezo-electric vibrator; and (2) a method of manufacturing a piezo-electric driver for an ink jet recording head, in which, according to the invention, a piezo-electric material and a conductive material are laminated to form a piezo-electric plate at least a front end portion of which is an inactive region;

a pressure facilitating front end plate is mounted on at least one surface of the inactive region in such a manner that the front end face thereof is flush with the front end face of the piezo-electric plate, the piezo-electric plate together with the front end plate is cut at predetermined intervals to form segments similar to teeth of a comb which form a plurality of piezo-electric elements, and while the front end plate is mounted on the front end portion of the piezo-electric plate as described above, the rear end plate is mounted on the rear end portion of the latter. Hence, the rear end plate holds the piezo-electric vibrators which are obtained by cutting the resultant product as described above. In addition, the rear end plate can be utilized for mounting the resultant vibrator assembly on a holding member with ease.

BRIEF DESCRIPTION OF THE DRAWING(S)

Figure 1:
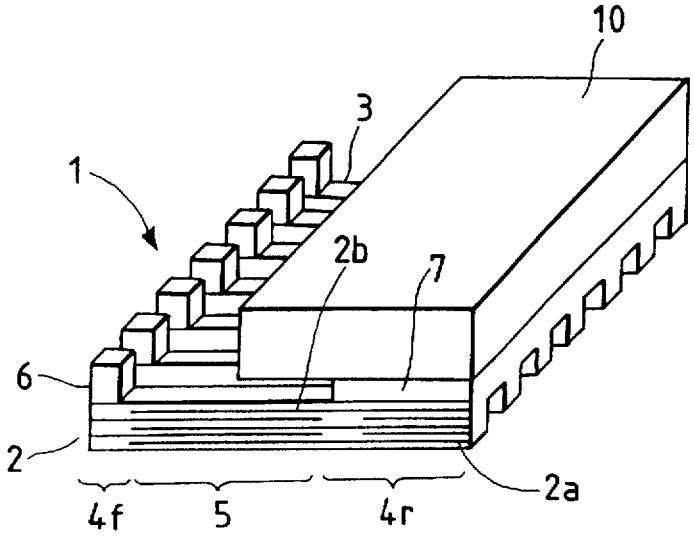
FIG. 1 is a perspective view showing a piezo-electric vibrator assembly, which constitutes one embodiment of this invention.

FIGS. 3(*a*) through 3(*e*) show perspective views for a description of a method of manufacturing the assembly shown in FIG. 1.

Figure 4:
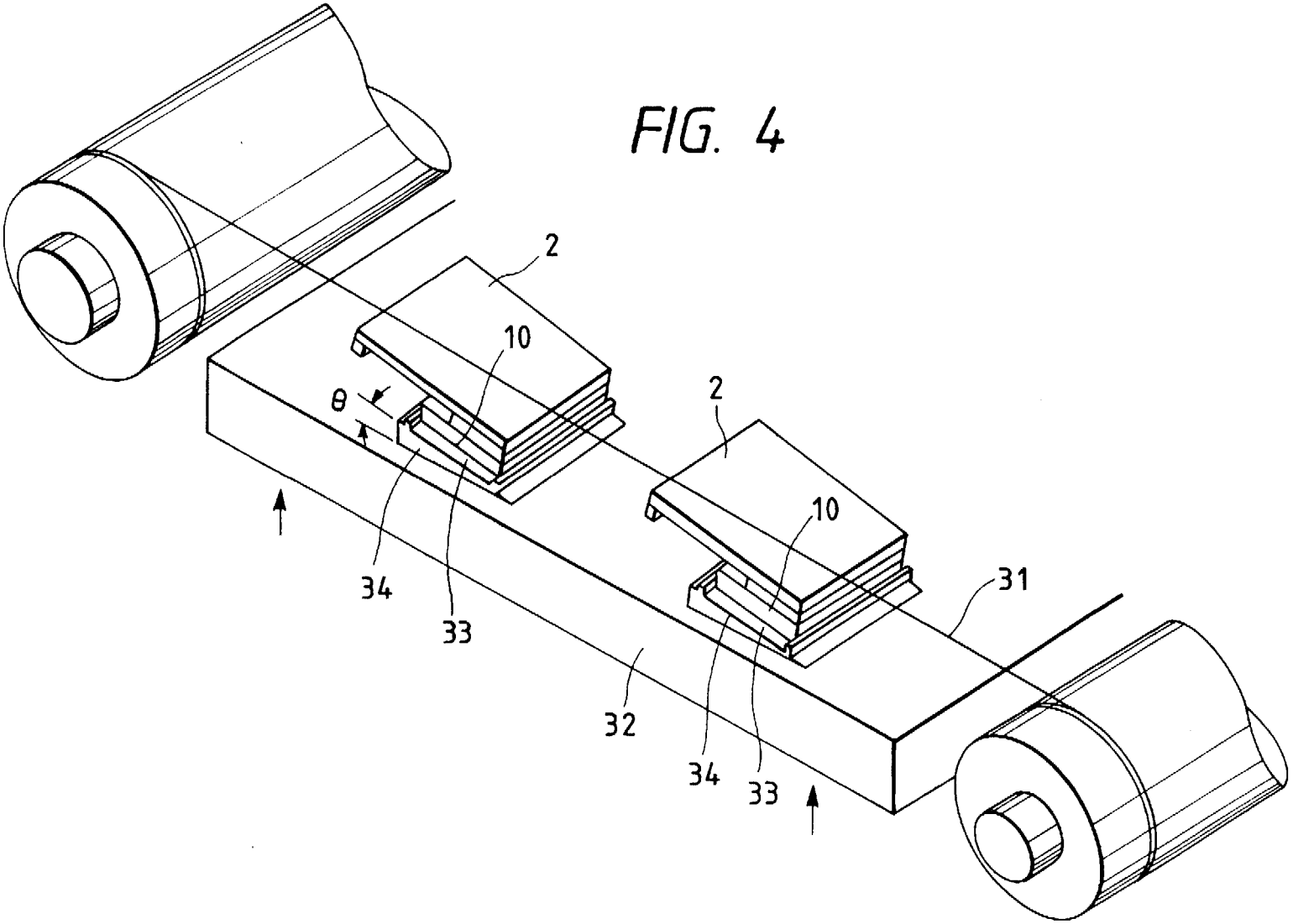

FIG. 4 is a perspective view showing the arrangement of a device for forming piezo-electric vibrators.

Figure 5A:
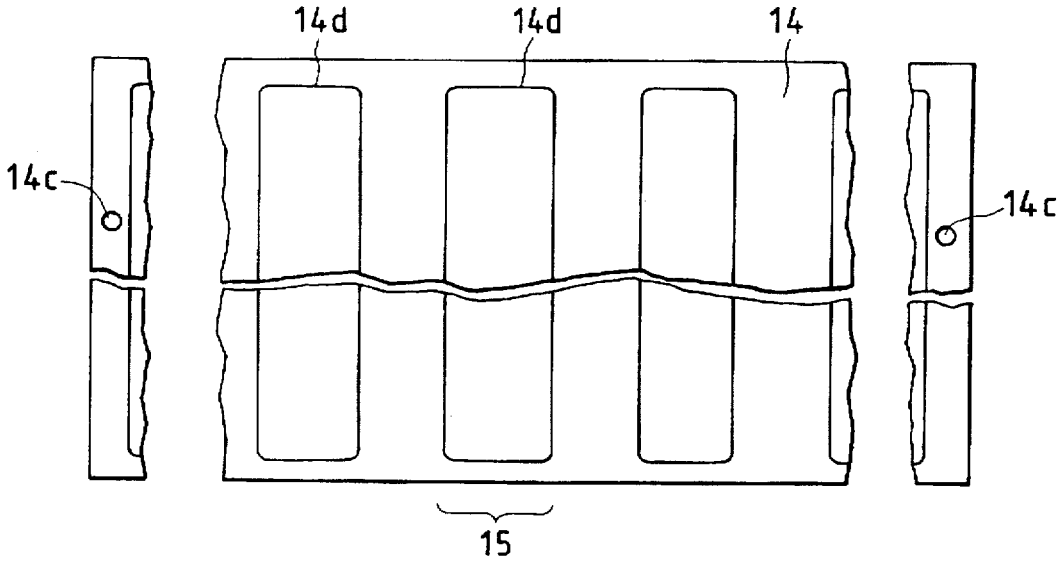
Figure 5B:
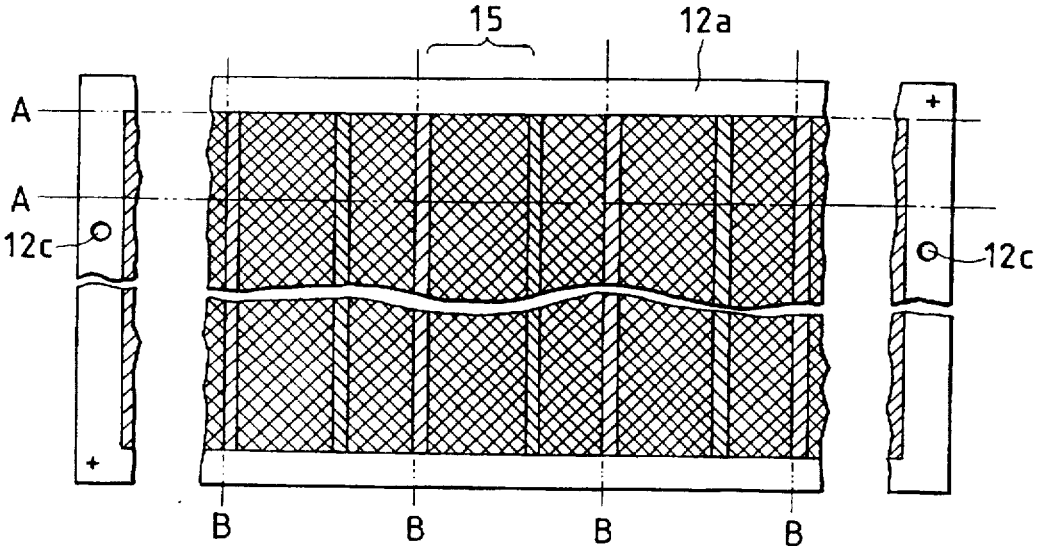
Figure 5C:
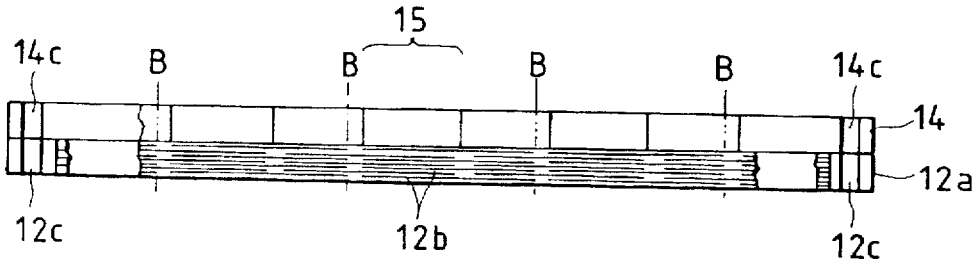

FIG. 5 shows another embodiment of the invention. More specifically, FIG. 5(*a*) is a diagram showing a front and rear end plate forming layer; FIG. 5(*b*) is a diagram showing a piezo-electric plate forming layer; FIG. 5(*c*), is a diagram showing the laminate of those layers.

Figure 6:
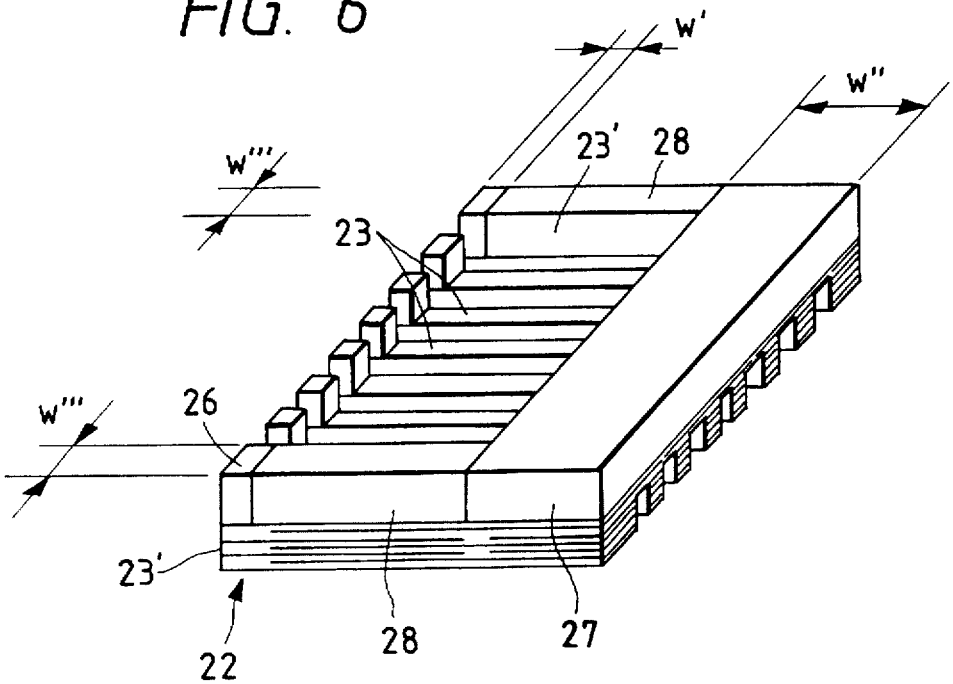

FIG. 6 is a perspective view showing a piezo-electric plate in another embodiment of the invention.

Figure 7:
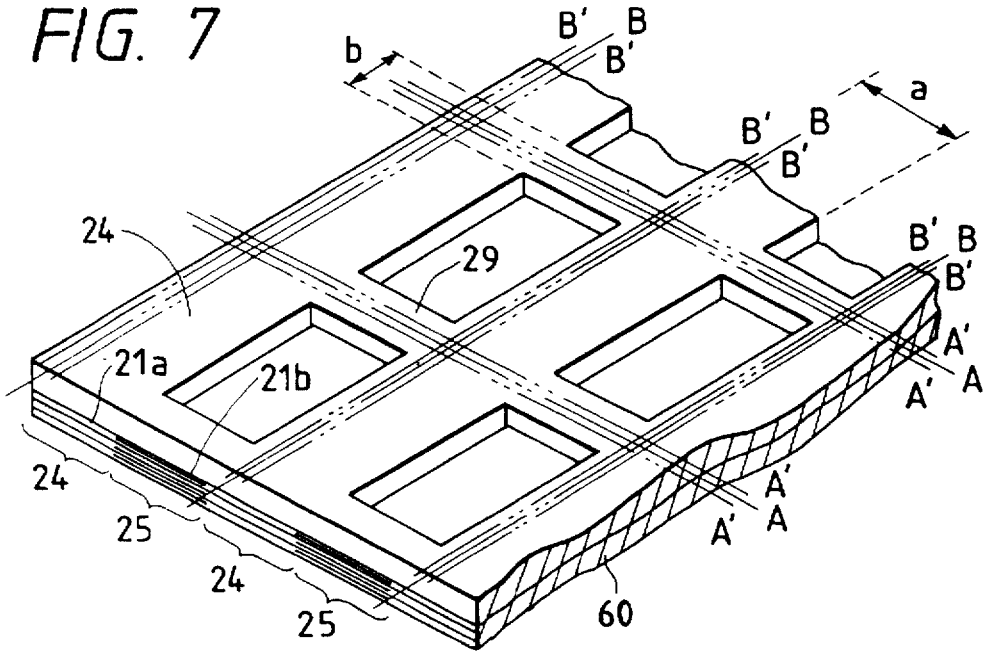

FIG. 7 is a perspective view for a description of a method of manufacturing the piezo-electric plate shown in FIG. 6.

Figure 8:
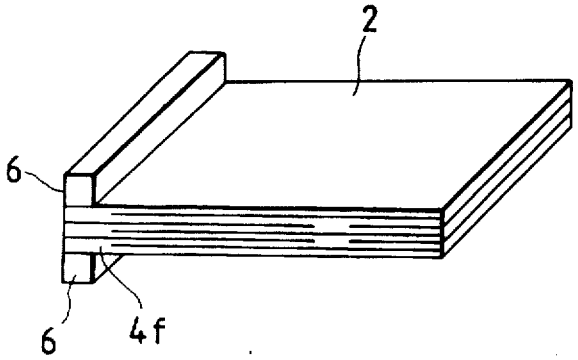

FIG. 8 is a perspective view showing another embodiment of the invention.

Figure 9:
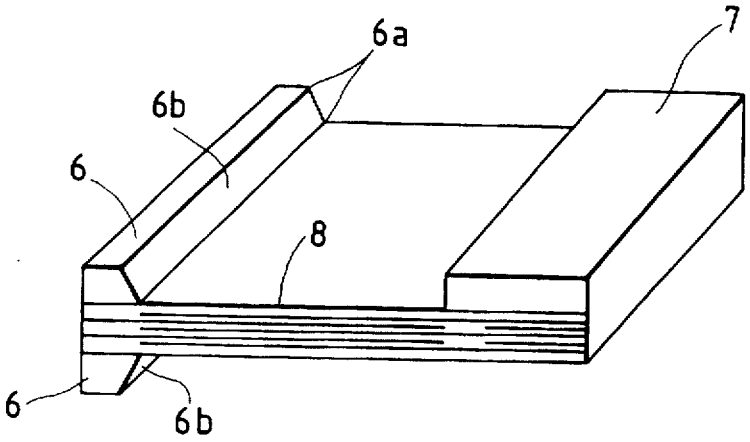

FIG. 9 is a perspective view showing a piezo-electric vibrator assembly, which constitutes another embodiment of the invention.

Figure 10A:
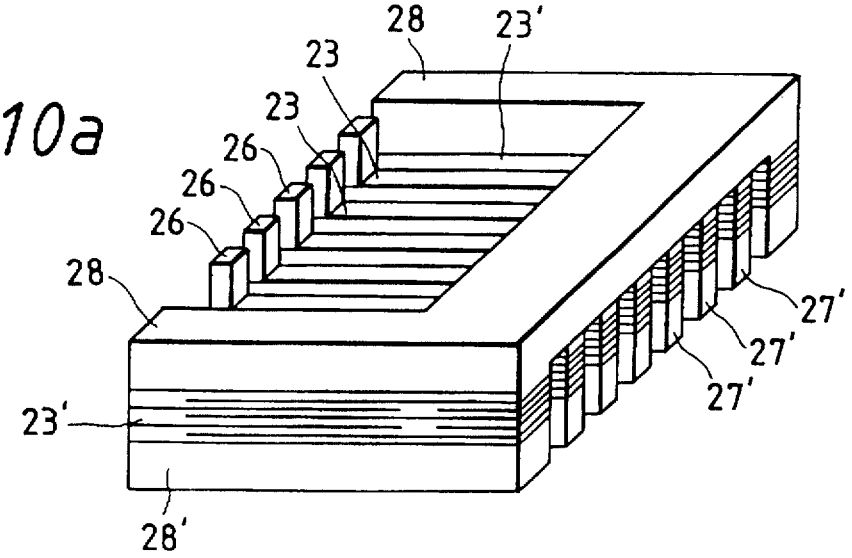
Figure 10B:
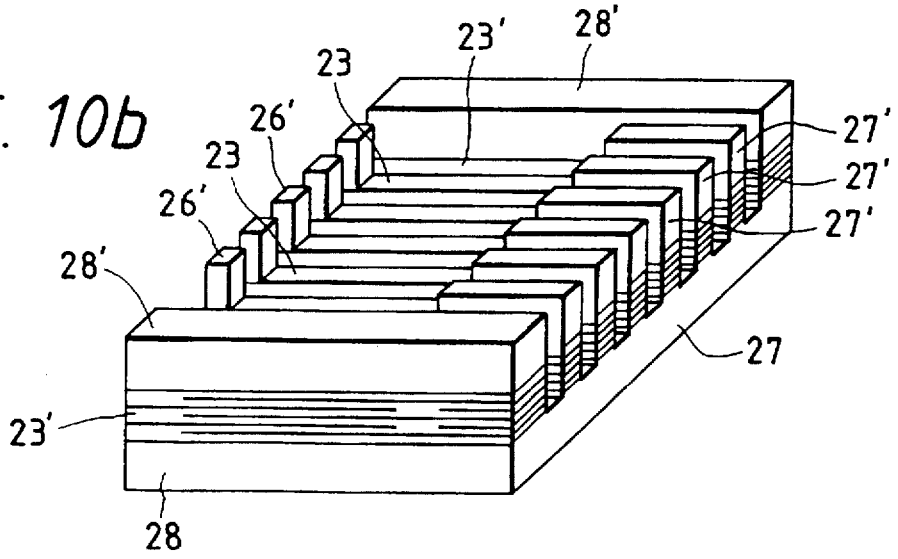
Figure 10C:
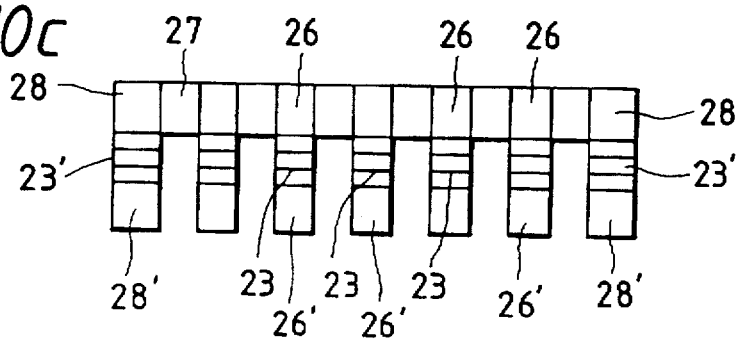

FIG. 10 shows a piezo-electric vibrator assembly, which constitutes another embodiment of the invention. More specifically, parts (a) and (b) of FIG. 10 are perspective views showing the top and the bottom of the piezo-electric vibrator assembly, respectively; and part (c) is a front side view of the piezo-electric vibrator assembly.

Figure 11:
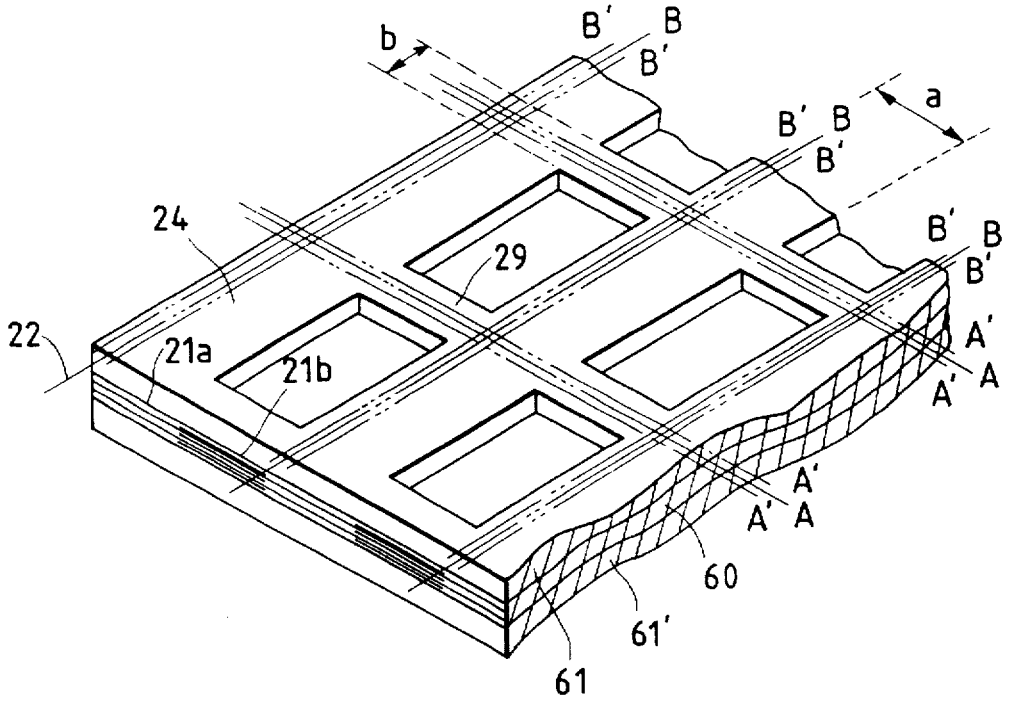

FIG. 11 is a perspective view of a method of manufacturing the piezo-electric vibrator assembly shown in FIG. 10.

Figure 12:
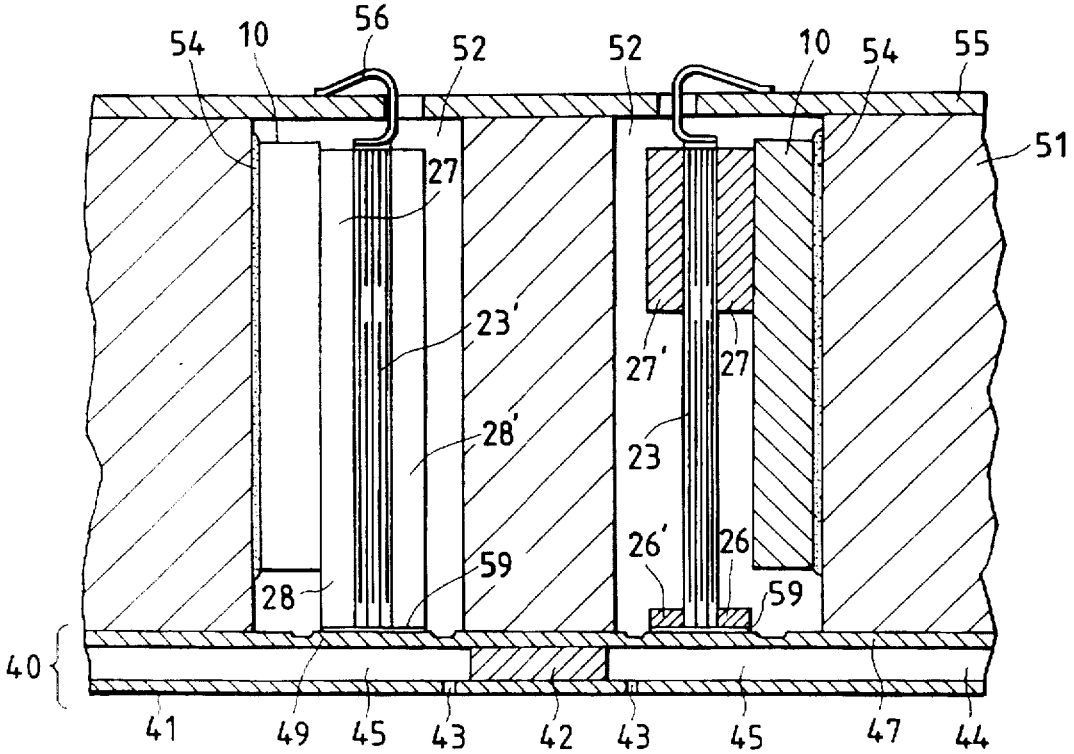

FIG. 12 is a sectional view of an example of an ink jet recording head using the piezo-electric vibrator assemblies show in FIG. 10, showing the dummy vibrators and the piezo-electric vibrators thereof.

Figure 13:
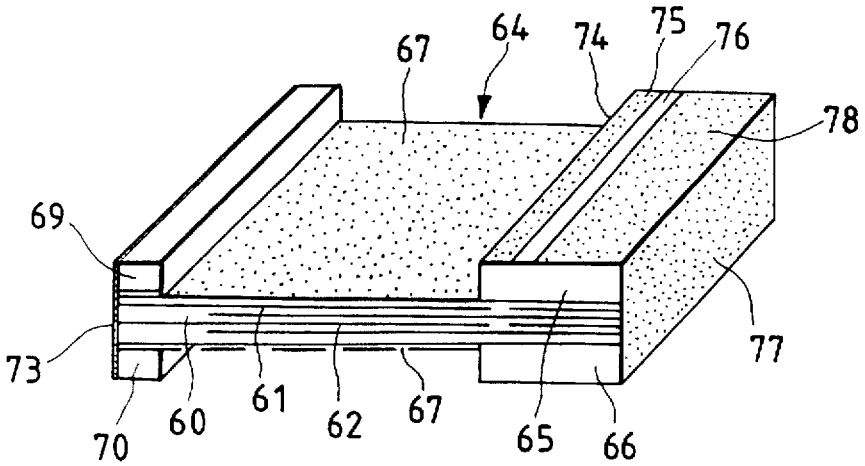

FIG. 13 is a perspective view of a piezo-electric vibrator assembly, which constitutes another embodiment of the invention.

Figure 14:
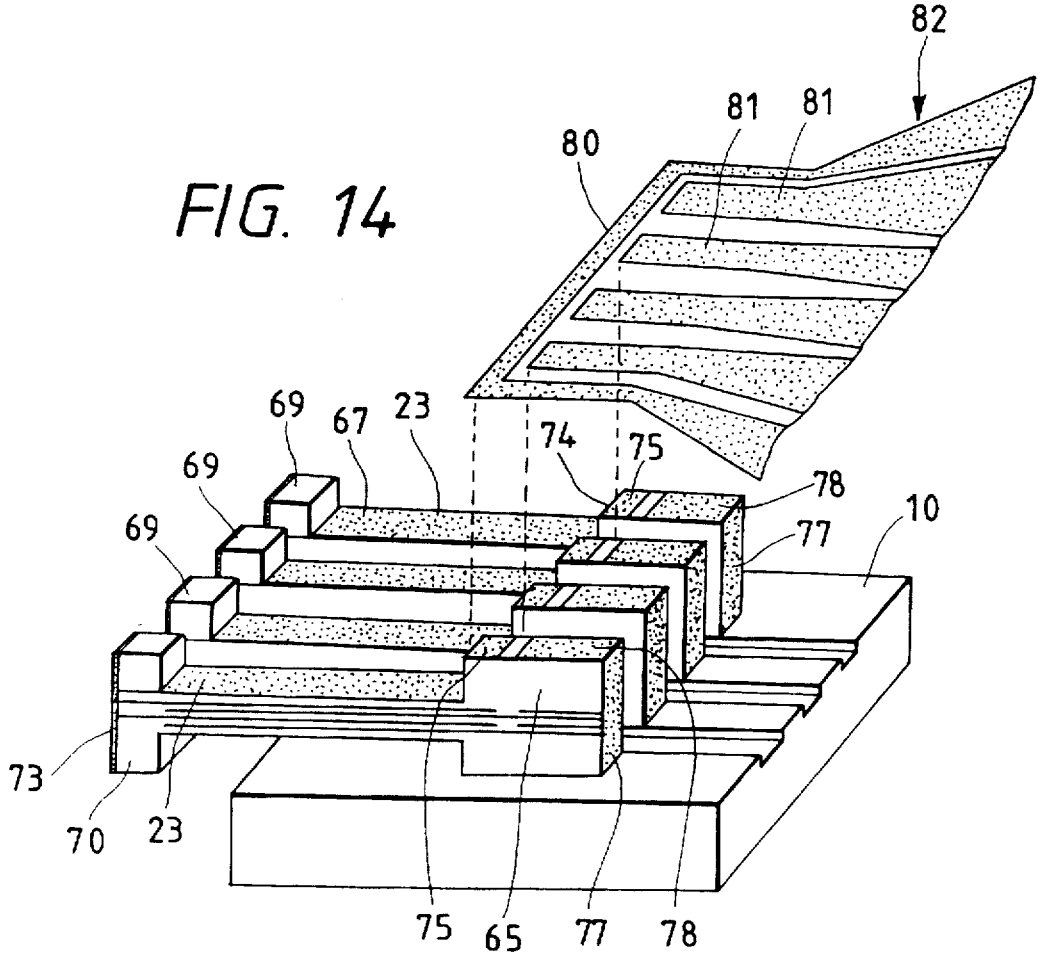

FIG. 14 is a perspective view of the assembly shown in FIG. 13, which is cut at predetermined intervals into pieces like the teeth of a comb.

Figure 15A:
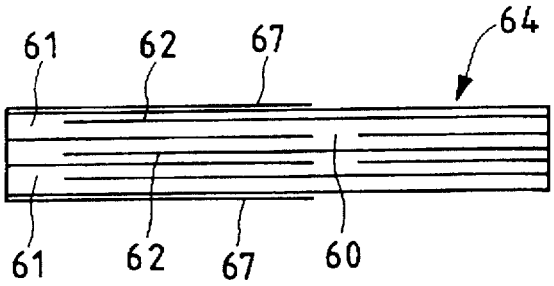
Figure 15B:
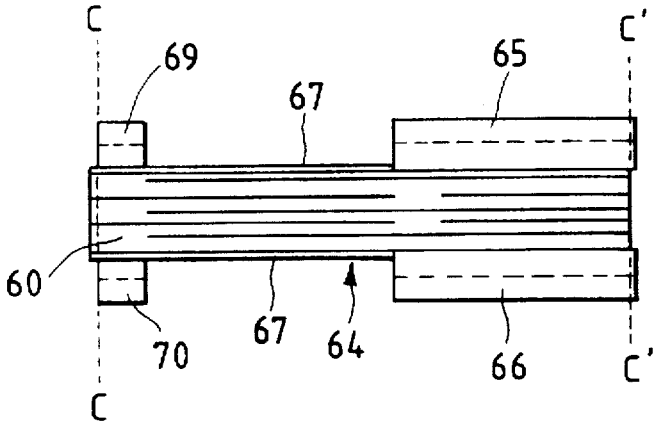
Figure 15C:
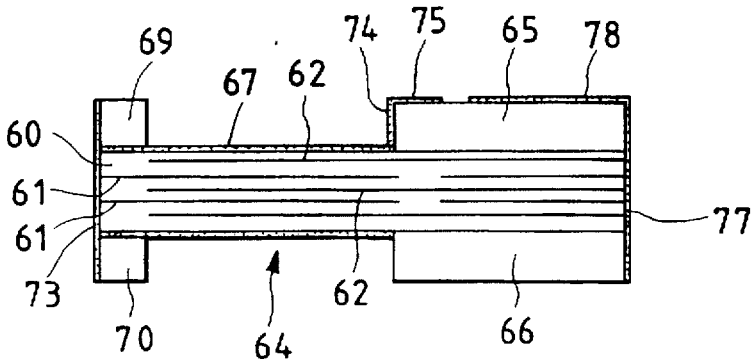

FIGS. 15(*a*) through 15(*c*) show the steps of manufacturing according to another embodiment of the invention.

Figure 16A:
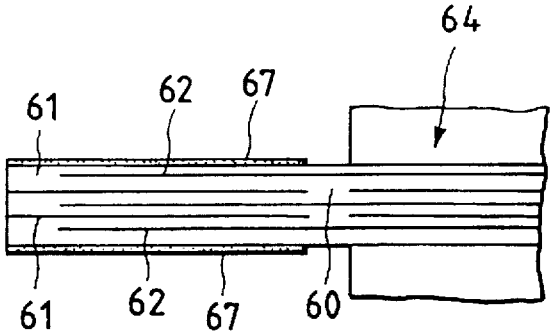
Figure 16B:
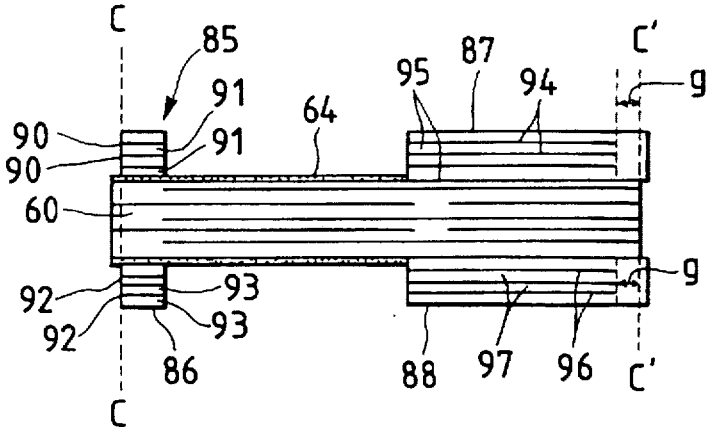
Figure 16C:
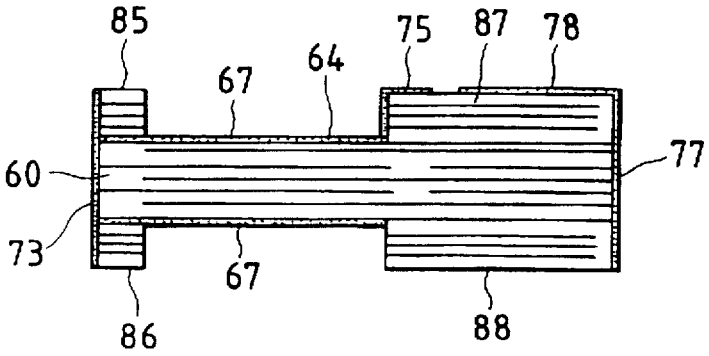

FIGS. 16(*a*) through 16(*c*) show the steps of manufacturing another embodiment of the invention.

Figure 17:
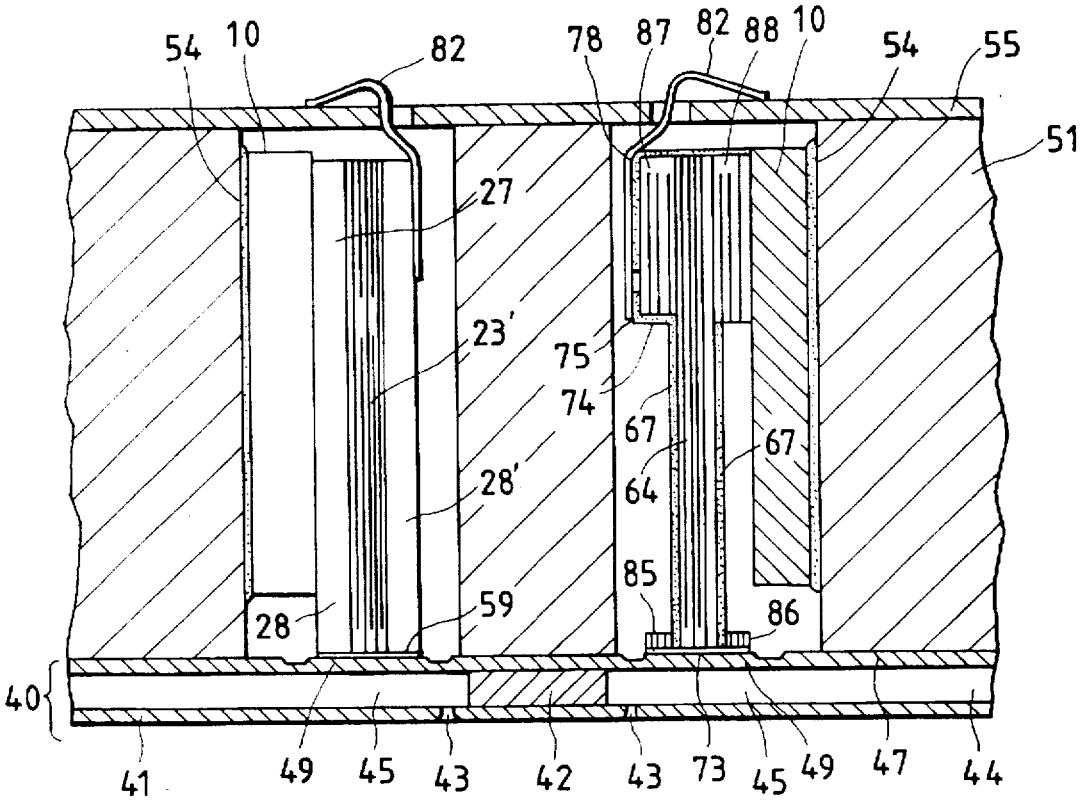

FIG. 17 is a sectional view showing the structure of an ink jet recording head using the piezo-electric vibrator assemblies shown in FIG. 16.

DETAILED DESCRIPTION OF THE PREFERRED EMBODIMENTS

Preferred embodiments of this invention will be described with reference to the accompanying drawings.

FIG. 1 shows a piezo-electric driver, which constitutes one embodiment of the invention.

In FIG. 1, reference numeral 1 designates a piezo-electric vibrator assembly from which the piezo-electric driver is formed. The assembly 1 comprises a piezo-electric plate 2 which is cut into pieces like the teeth of a comb together with a front end plate 6 adapted to increase a contact area and a metal plate 10 fixedly secured to the rear end portion of the piezo-electric plate 2 through a rear end plate 7 adapted to combine piezo-electric elements together, thus coupling the piezo-electric plate 2 to an ink jet recording head.

More specifically, in the assembly 1, one of its essential components, namely, the piezo-electric plate 2 is formed as follows: First, a paste-like piezo-electric material layer 2*a* having a front end portion and a rear end portion and a middle portion between them as viewed in the longitudinal direction is obtained. Conductive layers 2*b* are laminated in the middle portion of the paste-like piezo-electric material layer 2*a* so that the middle portion serves as an active portion 5. The remaining portions; i.e., the front end portion and the rear end portion serve as a front end inactive portion 4*f* and a rear end inactive portion 4*r*, respectively. The front end plate 6 and the rear end plate 7 are formed by using a paste-like free-cutting ceramic material which is, for instance, the same as the piezo-electric material. The front and rear end plates 6 and 7 thus formed are mounted on the front end inactive portion 4*f* and the rear end inactive portion 4*r*, respectively. These components are then formed into one unit by sintering.

In the embodiment, as shown in FIG. 3(*e*), the front end portion of the piezo-electric plate 2 together with the front end plate 6 is cut into pieces like the teeth of a comb with a wire saw or dicing saw, until the cutting line reaches the straight line connecting the rear edge of the top 6*a* of the front end plate 6 and the front edge 4*ra* of the rear end inactive portion 4*r*. The pieces thus obtained are piezo-electric driving elements 3 which, in response to voltage applied thereto, are moved across the electric field, to pressure the ink in the respective pressure chambers.

In the piezo-electric plate 2 thus formed, as shown in FIG. 3(*c*), an external electrode 8 is formed, or instance, by vapor deposition which extends from the lower surface of the active portion 5 through the surface of the front end plate 6 to the upper surface of the active portion 5; and similarly an external common electrode 9 is formed which extends from the rear end inactive portion 4*r* to the rear end face 7*a* of the rear end plate 7. Thereafter, the metal plate 10 of stainless steel or the like is fixedly mounted on the rear end plate 7 as shown in FIG. 3(*d*). Thus, the piezo-electric vibrator assembly 1 has been formed.

Figure 2:
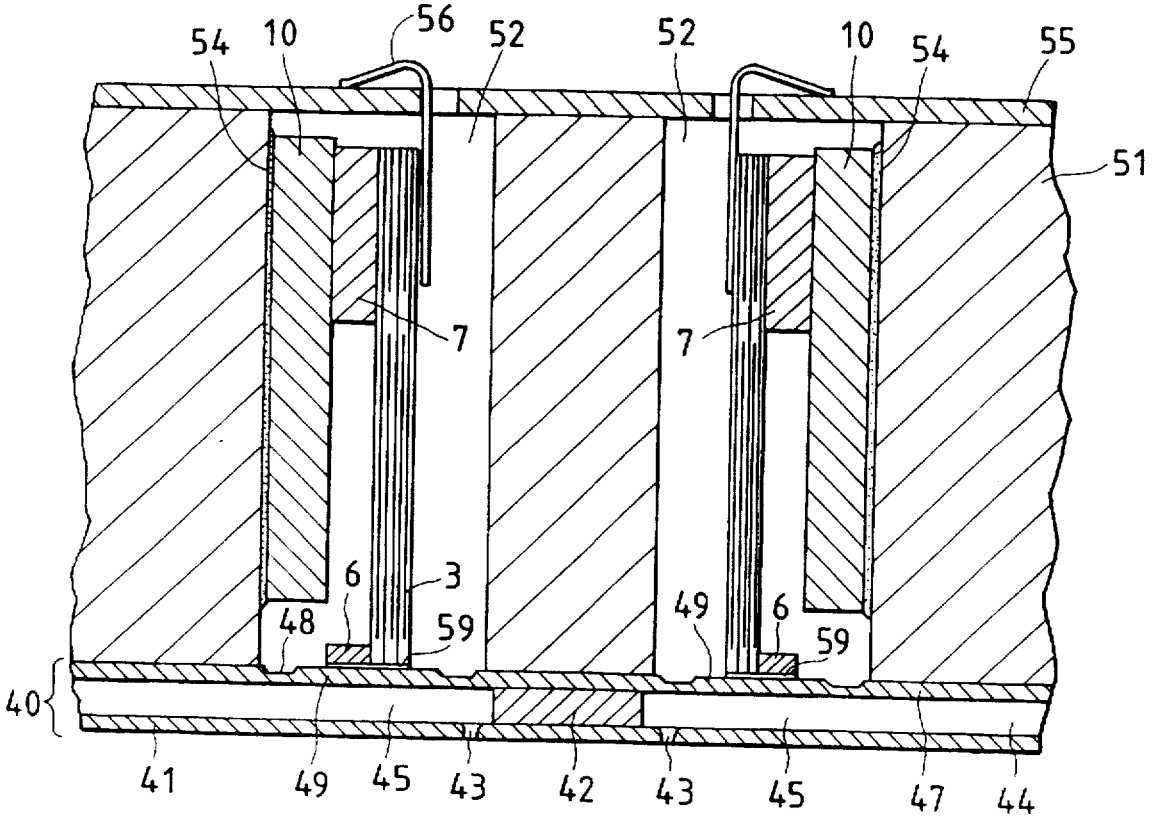
FIG. 2 is a sectional view showing an example of an ink jet recording head using the piezo-electric vibrator assembly shown in FIG. 1.

FIG. 2 shows an ink jet recording head equipped with the above-described piezo-electric vibrator assemblies 1.

Also shown in FIG. 2, reference numeral 41 designates a nozzle plate which has a number of nozzles 43 on both sides of a flow-path forming spacer 42 which are arranged in a direction perpendicular to the surface of the drawing. Behind the nozzle plate 41, a vibrating board 47 is provided in parallel with the nozzle plate 41 through a common ink chamber 44 and pressure chambers 45 formed on a flow-path forming board, thus forming a flow-path forming member 40.

In the rear surface of the vibrating board 47, annular grooves 48 are formed along the peripheries of the pressure chambers 45, thus providing island portions 49 which operate as follows: In response to the displacement of the piezo-electric vibrators 3, the island portions 49 are inwardly flexed while being kept in parallel with the nozzle plate 41.

Further in FIG. 2, reference numeral 51 designates a holding block of plastic which is fixedly secured to the rear surface of the flow-path forming member 40, to position the piezo-electric vibrator assemblies 1. The holding block 51 has two piezo-electric vibrator unit mounting holes 52 which have a width corresponding to the longitudinal length of the pressure chambers 45 and are arranged along the lines of the nozzles 43. The holding block 51 is mounted on the vibrating board 47 with an adhesive agent by utilizing a reference hole formed in the flow-path forming member 40.

A pair of piezo-electric vibrator assemblies 1 are inserted into the mounting holes 52 in such a manner that they face each other. As shown in FIG. 3(*d*), the metal plate 10 is larger than the rear end plate 7; that is, the former 10 is protruded from the upper and lower ends and the right and left ends of the latter 7. The metal plates 10 are bonded to the surfaces of the mounting holes 52 with an adhesive agent 54. In this operation, each of the metal plates 10 is positioned by using guide grooves formed on both sides of the mounting hole 52 so that the piezo-electric vibrators 3 are set on the portion 49 of the vibrating board 47 with high accuracy and the piezo-electric vibrators 3 are also prevented from being inclined in the direction of thickness. That is, positioning the metal plate 10 in the above-described manner allows the piezo-electric vibrators 3 to be bonded to the rear surfaces of the island portions 49 of the vibrating board 47 with adhesive agents 59. The adhesive agents 59 are applied to the end faces of the piezo-electric vibrators 3 with the end faces of the piezo-electric vibrators 3 in plane contact with the island portions 49. FIG. 2 also shows circuit board 55 provided on the positioning and holding block 51 and flexible cables 56.

With reference to FIG. 2, the piezo-electric vibrator assembly of the present invention provides the following advantages. The rear end plate 7 increases the rigidity of the piezo-electric plate 2. The assembly 1 can be readily coupled to a holding block 51 mounted on the rear of a flow-path forming member 40. The piezo-electric driving elements 3 including the front end plate pieces 6 are uniformly abutted against the whole areas of island portions 49 formed on a vibrating board 47 so that the island portions 49 are uniformly pushed against the surface of a nozzle plate 41, to pressure the ink in the pressure chambers 45.

Now, the manufacture of the above-described piezo-electric vibrator assembly 1 will be described with reference to FIG. 3.

First, a piezo-electric material layer 2a, which is substantially equal in configuration and in thickness to the piezo-electric plate 2, is formed by using a paste-like piezo-electric material such as lead titan-zirconate or barium titanate. Next, the piezo-electric material layer 2a is marked off into marginal portions. Specifically, in the middle portion of the piezo-electric material layer 2a except for the front end portion corresponding to 0.2 to 1.0 mm in length and the rear end portion corresponding to approximately 3.0 mm in length, conductive layers 2b of silver palladium are formed so as to overlap each other. The conductive layers are formed to have a thickness of about 3 μm by coating or vapor deposition. Thus, a green sheet for a single-layer-type piezo-electric plate 2 having the front inactive portion 4f, the rear inactive portion 4r, and the middle active portion has been formed (see FIG. 3(*a*-1)).

A multi-layer type piezo-electric plate is formed as shown FIG. 3(*a*-2). A paste-like piezo-electric s material layer 2a is formed to a thickness of 15 to 30 μm, and conductive layers 2b are alternately formed to a thickness of about 3 μm in such a manner that internal electrodes extended from the front and rear ends are overlapped in the middle portion of the piezo-electric material layer 2a leaving margins at the front and rear end portions. This process is repeated several times to obtain a green sheet for a multi-layer type piezo-electric plate 2 having the front and rear inactive portions 4f and 4r.

The remaining manufacturing steps will be described with reference to the multi-layer type piezo-electric plate 2. The green sheet thus formed for the piezo-electric plate 2 is processed as shown in FIG. 3(*b*). That is, the front and rear end plates 6 and 7 are mounted on the front and rear inactive portions 4f and 4r, respectively.

More specifically, the front end plate 6 of free cutting ceramic material which is substantially equal in thickness to the piezo-electric plate 2 is mounted on the front end inactive portion 4f with a small gap δ, preferably 0.0 to 0.5 mm, between the front end plate 6 and the active portion 5. Similarly, the rear end plate 7, which is larger in width than the front end plate 6, is mounted on the rear end inactive portion 4r. Thereafter, the piezo-electric plate 2 and the front end plate 6 are cut so that their front end faces are flush with each other, and then the piezo-electric plate 2 and the front and rear end plates 6 and 7 are combined into one unit by sintering. Alternatively, plates 2, 6, and 7 may be processed as follows: After they are combined into one unit by sintering, the piezo-electric plate 2 and the front end plate 6 are cut with the dicing saw or the like so that the front end faces of those plates 2 and 6 are flush with each other. The front end plate 6 and the rear end plate 7 may be lapped over the active portion 5 if they do not obstruct the displacement of the piezo-electric vibrators.

Next, as shown in FIG. 3(*c*), external segment electrodes 8 are vapor-deposited on the upper and lower surfaces of the active layer 5 including the front end plate 6 by applying vapor in the directions of the arrows D and E. An external common electrode 9 is vapor-deposited on the lower surface of the rear end inactive portion 4r and the rear end face 7a of the rear end plate 7 by applying vapor in the direction of the arrow F.

As was described above, the external segment electrode 8 is formed on the rear end face 6b of the front end plate 6 and on the upper surface of the piezo-electric plate 2 by vapor deposition in the direction of the arrow D. In order to prevent the electrode from being broken at the edge 6a of the front end plate 6, the rear end face 6b of the front end plate 6 should be sloped as shown in FIG. 9. For this purpose, the aforementioned sintering process may be utilized to make the coefficient of contraction of the piezo-electric material slightly larger than that of the front end plate 6, or the front end plate 6 should be machined to have the rear end face 6 sloped.

Thereafter, as shown in FIG. 3(*d*), the metal plate 10 larger both in length and in width than the rear end plate 7 is fixedly mounted on the latter 7 with an adhesive agent.

Finally, the piezo-electric vibrator assembly 1 thus formed is processed as follows: The assembly 1 is fixedly held with a jib. Then, as shown in FIG. 3(*e*), the front end portion of the assembly 1 is cut at intervals corresponding the pitch of arrangement of the nozzles 43 (shown as angle θ) into pieces like the teeth of a comb until the cutting line reaches the straight line L connecting the rear edge 6a of the top of the front end plate 6 and the front edge 4ra of the rear end inactive portion 4r.

FIG. 4 shows an example of a device for cutting the piezo-electric vibrator assembly 1. Sloped mounting members 34 are mounted on a jig body 32 which is moved vertically while being held in parallel with a wire saw 31. More specifically, each sloped mounting member 34 has a workpiece mounting surface 33 which is sloped in correspondence to the angle of inclination of the aforementioned straight line L, and it is fixedly mounted on the jig body 32 with the workpiece mounting surface 33 set oblique with the wire saw 31. The metal plate 10 is fixedly secured to the workpiece mounting surface 33 in such a manner that the front end portion of the piezo-electric plate 2 extends upwardly. Under this condition, the jig body 32 is moved vertically towards the wire saw 31, to cut the piezo-electric vibrator assembly in the above-described manner.

FIG. 5 shows another embodiment of the invention, in which a number of piezo-electric plates 2 can be formed from a large size plate. FIG. 5(*a*) shows a front and rear end plate forming layer. FIG. 5(*b*) shows a piezo-electric plate forming layer 12a and FIG. 5(*c*) shows the lamination of those layers.

First, a piezo-electric plate forming layer 12a is formed by using a paste-like piezo-electric material which is large enough to arrange a number of piezo-electric plates 12 in the longitudinal direction and in the lateral direction on it. Next, as shown in FIG. 5(*b*), two kinds of internal electrodes 12b which are indicated by hatchings sloped upwards to the right and upwards to the left are alternately printed as patterns while clamping the piezo-electric plate forming layer 12a, thereby forming active portions 15 (crossed region) at intervals which are equal to or slightly larger than the longitudinal dimension of the piezo-electric plate 12.

The formation of the two kinds of internal electrodes 12b is carried out by using a printing mask which is set to the mark (+) on the piezo-electric plate forming layer 12a. In the formation of those internal electrodes 12b, it is essential that they do not extend out of the piezo-electric plate forming layer 12a.

The front and rear end plate forming layer 14 is to form the front and rear end plates 14f and 14r. The front and rear end plate forming layer 14 is equal in size to the piezo-electric plate forming layer 12a. As shown in the part (a) of FIG. 5, the front and rear end plate forming layer 14 has reference holes 14c which are in alignment with reference holes 12c formed in the piezo-electric plate forming layer 12*a*. With the reference holes 14*c* as reference points, windows 14*d* corresponding to the regions of the active portions 15 are formed in the layer 14. Thereafter, the layer 14 is placed on the piezo-electric plate forming layer 12*a* with pins inserted into the reference holes 12*c* and 14*c*, and then those layers are formed into one unit by sintering under pressure.

Next, the resulting product is cut along one or two cutting lines B which define the front end plate 14*f* and the rear end plate 14*r*, and external electrodes are formed on the surface thereof.

As was described above, the internal electrodes 12*b* do not extended outside the piezo-electric plate forming layer 12*a*. Hence, the formation of the external electrodes can be achieved without a mask which covers the outer side of the piezo-electric plate. After the formation of the external electrodes, a voltage of 75 v is applied to those electrodes for one minute for polarization. Thereafter, the resulting product is cut along cutting lines A to obtain a number of piezo-electric plates 2.

As shown in FIG. 2, in the piezo-electric vibrator assembly 1 formed in the above-described manner, the piezo-electric vibrators 3 are combined together with the rear end plate 7 as a common base, and the front end plate 6 is cut in correspondence to the piezo-electric vibrators 3, thus uniformly depressing the island portions 49 on the vibrating board 47.

FIGS. 6 and 7 shows another example of the piezo-electric vibrator assembly according to the invention, and its manufacturing method.

In the piezo-electric vibrator assembly 1, a piezo-electric plate 22 has dummy vibrators 23' on both sides. The dummy vibrators 23' are used only to position other components during assembling; that is, they are not related to the recording operation of the recording head at all. A front end plate 26 and a rear end plate 27 are coupled to each other through side plates 28 mounted on the dummy vibrators 23' of the piezo-electric plate 22, so that the latter 22 is held reinforced during both forming and installing the piezo-electric vibrator assembly 1.

The assembly is manufactured as shown in FIG. 7. A piezo-electric plate forming green sheet 60 relatively large in area is prepared. The green sheet 60 is a laminate comprising a piezo-electric material layer 21*a*, and conductive layers 21*b* provided in the active portions 25 of the latter 21*a*. In the longitudinal direction of the green sheet 60, a plurality of plates 24 having a width a which is equal to or slightly larger than the sum of the width w' of the front end plate 26 and the width w" of the rear end plate 27 (see FIG. 6) are laid on the inactive portions of the piezo-electric plate forming green sheet 60 at intervals corresponding to at least the length of the piezo-electric plate 22. In the lateral direction of the green sheet 60, plates 29 having a width b which is equal to or slightly larger than two times the width w'" of the side plate 28 are laid on the active portions 25 of the green sheet 60 at intervals corresponding to at least the width of the piezo-electric plate 22.

Next, the resultant product is cut in the longitudinal direction and in the lateral direction. More specifically, in the longitudinal direction, the product is cut along cutting lines B or B' (double line) which divide the plates 24 into the front and rear end plates 26 and 27; and, in the lateral direction, it is cut along cutting lines A or A' (double line) which divide the plates 29 into two equal parts, to obtain a plurality of piezo-electric plates 22. The piezo-electric plates 22 are then sintered. Alternatively, first the aforementioned product may be sintered, and then cut in the above-described manner, to obtain a plurality of piezo-electric plates 22. Thereafter, as was described before, the front end portion of each of the piezo-electric plates 22 is cut into pieces like the teeth of a comb to form a number of piezo-electric vibrators 23.

In the above-described method, the front end plate 6 (or 26) and the rear end plate 7 (or 27) are mounted on the piezo-electric plate 2 (or 22) and are sintered into one unit (see FIG. 3(*b*)). However, the same effect can be obtained by processing those components as follows. The piezo-electric plate 2 (or 22), the front end plate 6 (or 26), and the rear end plate 7 (or 27) are sintered separately, and then they are combined into one unit by using a suitable adhesive.

In addition, as shown in FIG. 8 a pair of front end plates 6 may be fixedly mounted on the upper and lower surfaces of the front end inactive portion 4*f* of the piezo-electric plate 2. In this case, the island portions 49 of the vibrating board 47 can be more widely pressed with high stability.

FIG. 10 shows another embodiment of the invention. More specifically, FIG. 10(*a*) and (*b*) are a perspective top view and a perspective bottom view showing the top and bottom of another example of the piezo-electric vibrator assembly of the invention, respectively, and FIG. 10(*c*) is a front side view of the assembly. In FIG. 10, reference numeral 23 designates the above-described piezo-electric vibrators; and 23', the above-described dummy vibrators. The dummy vibrators 23' are provided on both sides of a group of piezo-electric vibrators 23 and they are used only for positioning other components during assembling; that is, they are not related to the recording operation of the recording head at all. The above-described rear end plates 27 and 27' are mounted on the upper and lower surfaces of the rear end portions of the piezo-electric vibrators 23 and of the dummy vibrators of the piezo-electric vibrators 23 and of the dummy vibrators 23', respectively. Similarly, the above-described front end plates 26 and 26' are mounted on the upper and lower surfaces of the piezo-electric vibrators 23, respectively. In addition, side plates 28 and 28' equal in length to the dummy vibrators 23' are mounted on the upper and lower surfaces of each of the dummy vibrators 23', respectively, in such a manner that they merge with the rear end plates 27 and 27, respectively.

A method of manufacturing the piezo-electric vibrator assembly shown in FIG. 10 will be described with reference to FIG. 11.

First, a piezo-electric plate forming green sheet 60 having a relatively large area is formed which is a laminate of piezo-electric material layers 21*a* and conductive layers 21*b*. A layer 61 is formed on one surface of the green sheet 60 by using ceramic or the same material as that of the green sheet 60. More specifically, the layer 61 comprises: a plurality of plates 24 having a width a, which is equal to or slightly larger than the sum of the widths w' and w" of the front and rear end plates 26 and 27, which are laid on the inactive portions 24 in the longitudinal direction at intervals corresponding to at least the length of the piezo-electric plate 22; and plates 29 having a width b which is equal to or slightly larger than two times the width w'" of the side plate 28 which are laid on the active portions 25 in the lateral direction at intervals corresponding to at least the width of the piezo-electric plate 22.

Another ceramic layer 61' equal in structure to the above-described ceramic layer 61 is formed on the other surface of the green sheet 60.

Next, the resultant product is cut in the longitudinal direction and in the lateral direction. More specifically, in the longitudinal direction, the product is cut along cutting lines B or B' (double line) which divide the plates 24 into the front and rear end plates 26 and 27; and, in the lateral direction, it is cut along cutting lines A or A' (double line) which divide the plates 29 into the two equal parts, to obtain a plurality of piezo-electric plates 22. The piezo-electric plates 22 are sintered. Alternatively, first the aforementioned product may be sintered, and then cut in the above-described manner, to obtain a plurality of piezo-electric plates 22. Thereafter, as was described before, the front end portion of each of the piezo-electric plates 22 is cut into pieces like the teeth of a comb thus forming a number of piezo-electric vibrators 23.

As shown in FIG. 12, the piezo-electric vibrator assemblies thus manufactured are inserted into mounting holes 52 in such a manner that they face each other. In each of the assemblies, the metal plate 10 is protruded from the upper and lower ends and right and left ends of the rear end plates 27 and 27'. The metal plates 10 are bonded to the surfaces of mounting holes 52 with an adhesive agent 54. In this operation, each of the metal plates 10 is positioned by using guide grooves formed on both sides of the mounting hole 52 so that the piezo-electric vibrators are set on the island portions 49 of the vibrating board 47 with high accuracy and the piezo-electric vibrators 3 being prevented from being inclined in the direction of thickness. That is, positioning the metal plate 10 in the above-described manner allows the piezo-electric vibrators 3 to be bonded to the rear surfaces of the island portions 49 of the vibrating board 47 with adhesive agents 59. The adhesive agents 59 are applied to the end faces of the piezo-electric vibrators 3 with the end faces piezo-electric vibrators in plane contact with the island portions 49.

In the above-described embodiment, the dummy vibrators 23' are reinforced by the side plates 28 and 28', and therefore they are positively prevented from being bent in the recording head.

FIG. 13 shows another embodiment of the invention. In the embodiment, a piezo-electric vibrating board 64 is formed by alternately laminating piezo-electric materials 60 and conductive layers 61 and 62. Rear end plates 65 and 66 are fixedly mounted on the upper and lower surface of the rear end portion of the piezo-electric vibrating board 64. The other electrodes; namely, external conductive layers 67, which are common electrodes in the embodiment, are formed on the upper and lower surface of the piezo-electric vibrating board 64 in such a manner that they are extended from the front end of the latter 64 to the border lines of the end plates 65 and 66, respectively. Front end plates 69 and 70 are fixedly mounted on the upper and lower surface of the front end portion of the piezo-electric vibrating board 64, respectively. The rear end plates 65 and 66, and the front end plates 69 and 70 are formed from ceramic, preferably piezo-electric material.

A conductive layer 73 is formed on the front end face of the resultant product in such a manner that it is electrically connected to the conductive layer 67 on the upper surface of the piezo-electric vibrating board 64 and to the conductive layers 62 appearing in the front end face. The rear end plates 65 and 66 have conductive layers 74 and 75, and conductive layers 77 and 78. The conductive layers 74 and 75 are provided on one side and a part of the upper surface of the rear end plate 65, respectively, in such a manner that they are electrically connected to the conductive layer 67 formed on the upper surface of the piezo-electric vibrating board 64. On the upper surface of the rear end plate 65, an insulating region 76 having a predetermined width is provided adjacent to the conductive layer 75. Furthermore, the conductive layer 78 is provided adjacent to the insulating region 76 on the upper surface of the rear end plate 65, and the conductive layer 77 is provided on the rear end face of the product in such a manner that it is electrically connected to the other electrodes (drive electrodes in the embodiment), namely, the conductive layers 61 appearing in the rear end face of the piezo-electric vibrating board 64.

As shown in FIG. 14, the piezo-electric vibrating board 64 thus formed in fixedly mounted on a substrate 10, and then its front end portion is cut into pieces like the teeth of a comb as described above. Thereafter, a cable 82 having a conductive strip 80 and conductive strips 81 in the front end is soldered to the piezo-electric vibrating board 64 thus processed, so that the conductive strip 80 is connected to the common electrode, namely, the conductive layer 75, and the conductive strips 81 are connected to the conductive layer 78 divided at a predetermined interval.

In the embodiment as shown in FIG. 14, the front end plates 69 and 70 equal in structure to each other are mounted on the upper and lower surfaces of the front end portion of each of the piezo-electric vibrators 23. Similarly the rear end plates 65 and 66 equal in structure to each other are mounted on the upper and lower surfaces of the rear end portion of the piezo-electric vibrators 23. The front end plates and rear end plates prevent the piezo-electric vibrators from being bent in manufacturing because of the symmetric structure. The external conductive layers 67 also prevent the piezo-electric vibrators from being bent by reinforcing the piezo-electric vibrators. Since the rear end plates 65 are higher in mechanical strength than the piezo-electric vibrators 23, the cable 82, which is connected to the rear end plates, can be positively connected to the piezo-electric vibrators. Furthermore, when necessary, conductive layers may be additionally formed on the conductive layer 62 to decrease the electrical connecting resistance.

This is a significant aspect of the present invention shown in FIG. 14 because the piezo-electric vibrators in a recording head for high density printing are traditionally extremely small in width, and accordingly the connecting area between the cable and the piezo-electric vibrators is extremely small, thereby creating an extremely high electrical resistance. Therefore, a large amount of heat is generated in the region surrounding these connecting points such as corners or ridge lines of the front end plate shown in FIG. 3(*e*) which can cause damage in the recording head. By reducing the connecting resistance, the present invention as shown in FIG. 14, makes it possible to reduce the amount of thermal damage suffered by the recording heads and further reduces the damage caused by loss of driving energy.

FIG. 15 show a method of manufacturing the above described piezo-electric vibrator assemble. In FIG. 15, reference numeral 64 designates the piezo-electric vibrating board which is formed by alternately laminating the piezo-electric materials 60 and the conductive layers 61 and 62. The external electrode layers 67, which are equal in polarity to the conductive layers 61, are formed on the upper and lower surface of the piezo-electric vibrating board 64 by vapor deposition or coating, respectively, in such a manner that they are extended from the front end of the board 64 to the border lines of the rear end plates 65 and 66, respectively (FIG. 15(*a*) and (*b*)).

The front end plates 69 and 70 are fixedly mounted on the upper and lower surface of the front end portion of the piezo-electric vibrating board 64, respectively. Similarly, the rear end plates 65 and 66 are fixedly mounted on the upper and lower surface of the rear end portion of the board 64, respectively. When necessary, the outer end portions of the front end plates and those of the rear end plates are cut along lines C—C and C'—C', respectively, as shown in FIG. 15(*b*).

The front end plates 69 and 70, and the rear end plates 65 and 66 may be formed by using a green sheet which is equal in composition to the piezo-electric vibrating board 64, or a green sheet of free-cutting ceramic. Alternatively, those green sheets may be stacked one on another to a desired thickness. The resultant product is sintered (see FIG. 15(*b*)).

Thereafter, the conductive layer 73 is formed on the front end faces of the piezo-electric vibrating board 64 and the conductive layers 74 and 75 are formed on the upper and side surface of the rear end plates 65 and 66, and the conductive layers 78 and 77 are formed on a part of the upper surface of the rear end plate 65 and rear end face, respectively. The conductive layer 78 is utilized as connecting terminals to external devices.

The product thus formed is fixedly mounted on the substrate 10, for instance, with an adhesive, and then the front end portion thereof is cut at predetermined intervals into pieces like the teeth of a comb.

FIG. 16 shows steps of manufacturing another example of the piezo-electric vibrating board.

Similarly as in the above-described case, the piezo-electric vibrating board 64 is formed by alternately laminating piezo-electric materials 60 and conductive layers 61 and 62. External electrode layers 67, which are equal in polarity to the conductive layers 61, are formed on the upper and lower surface of the piezo-electric vibrating board 64, respectively, in such a manner that they are extended from the front end of the board 64 to the border lines of rear end plated 65 and 66, respectively (FIG. 16(*a*)).

As shown in FIG. 16(*b*), front end plates 85 and 86 are fixedly mounted on the upper and lower surface of the front end portion of the piezo-electric vibrating board 64, respectively. Similarly, rear end plates 87 and 88 are fixed mounted on the upper and lower surface of the rear end portion of the board 64, respectively.

In the embodiment, those plates 85, 86, 87, and 88 are formed by alternately laminating green sheets 91, 93, 95 and 97 of piezo-electric material and conductive layers 90, 92, 94 and 96 as follows: More specifically, as in the case of the piezo-electric vibrating board, the green sheets 91 and the conductive layer 90 are alternately laminated to form the front end plate 85; the green sheets 93 and the conducive layers 92, to form the front end plate 86; the green sheets 95 and the conducive layers 94, to form the rear end plate 87; and the green sheets 97 and the conducive layers 96, form the rear end plate 88.

In the above-described lamination, in order to prevent the external conductive layers 75 and 77 from short circuiting the conductive layers 94 and 96 buried respectively in the rear end plates 87 and 88, the conductive layers 94 and 96 are shifted a predetermined distance g inwardly from the outer end faces of the latter 87 and 88, respectively. The same effect can be obtained by making cuts in the conductive layers 94 and 96.

In the embodiment described above, the conductive layers are buried in the green sheets of ceramic. Hence, the resultant product, when sintered, is substantially equal in the degree of contraction to the piezo-electric vibrating board, which effectively prevents the piezo-electric vibrating board from warpage. When necessary, the outer end portions of the piezo-electric vibrator assemble may be cut as shown in the FIG. 16(*b*).

Thereafter, as shown in FIG. 16(*c*), a first conductive layer 73 is formed on the front end faces of the piezo-electric vibrating board 64 and on the front end plates 85 and 86, a second conductive layer 78 is formed on the rear end faces of the rear end plates 87 and 88, and a third conductive layer 75 and 78 is formed on a part of the upper surface of the rear end plate 87.

Under this condition, similarly as in the above-described embodiment, the resultant product is fixedly mounted on the substrate 10, and then cut at predetermined intervals into pieces like the teeth of a comb as described above for the embodiment shown in FIG. 14.

FIG. 17 is a sectional view showing the structure of an ink jet recording head equipped with piezo-electric vibrator assemblies which have been formed in the above-described manner. The conductive layer 73 formed on the front end faces of the front end plates 85 and 86 and of the piezo-electric vibrating board 64 is in contact with the island portion 49. Conductive layers 75 and 78 formed on the rear end plate 87 are connected to the cable 82.

As shown in FIG. 16(*b*) and described above, conductive layers 90, 92, 94, and 96 are buried in the front end plates 85 and 86 and the rear end plates 87 and 88, which effectively prevents the piezo-electric vibrating board from warpage.

Hence, even if the piezo-electric vibrating board 64, and accordingly the piezo-electric material 60 is reduced in thickness, the resultant piezo-electric vibrator assembly operates with high accuracy. This permits miniaturization and low-voltage operation of the recording head.

In the above-described embodiment, the conductive layers are buried in the front end plates 85 and 86 and the rear end plates 87 and 88 which are fixedly mounted on the upper and lower surfaces of the piezo-electric board 64. This technical concept may be applied to the piezo-electric vibrator assembly as shown in FIG. 1 in which the front end plate and the rear end plate are formed on one side of the piezo-electric plate by sintering ceramic. That is, in this case too, burying the conductive layers in the front and rear end plates prevents the piezo-electric plate from warpage.

What is claimed is:

1. A method of manufacturing a piezo-electric driver for an ink jet recording head comprising the steps of:

laminating a piezo-electric material and a conductive material to form a piezo-electric plate having a front end face and having at least a front end portion which includes an inactive region;

mounting a front end plate having a front end face on at least a first surface of said inactive region in such a manner that said front end face of said front end plate is flush with said front end face of said piezo-electric plate; and cutting said piezo-electric plate together with said front end plate at predetermined intervals to form a plurality of piezo-electric elements.

2. A method as claimed in claim 1 wherein said laminating step comprises forming a rear end portion of said piezo-electric plate, said rear end portion including an inactive region, and further comprising mounting a rear end plate on said inactive region of said rear end portion.

3. A method as recited in claim 1 or 2 wherein said front end plate is a plate made of free-cutting ceramic material and further comprising sintering said front end plate of free-cutting ceramic material and said piezo-electric plate for form a single unit.

4. A method as claimed in claim 3 wherein said sintering step is performed separately on said front end plate and said piezo-electric plate before said mounting step.

5. A method as claimed in claim 2 further comprising the steps of:

laying down plate forming layers on said inactive regions on at least one side of said piezo-electric plate; and cutting said piezo-electric plate and said plate forming layers along lines which divide said plate forming layers into said front end plates and said rear end plates.

6. A method as claimed in claim 1 or 5 further comprising overlapping two kinds of internal electrode patterns on said piezo-electric material with a reference portion which is provided in said piezo-electric material.

7. A method as claimed in claim 6 further comprising forming said piezo-electric plate so that said internal electrode patterns do not appear on both sides thereof.

8. A method of manufacturing a piezo-electric vibrator assembly comprising the steps of:

forming a laminate comprised of a piezo-electric material layer and a conductive material layer;

laying longitudinal plate forming materials each defining a front end plate and a rear end plate as a single unit onto said laminate in a longitudinal direction of said laminate;

laying lateral plate forming materials onto said laminate in a lateral direction of said laminate;

cutting said laminate longitudinally along lines which divide said plate forming materials into said front end plates and said rear end plates; and cutting said laminate laterally along lines which substantially divide said lateral plates into two parts.

9. A method as claimed in claim 2 wherein the front end portion of said piezo-electric plate is cut at predetermined intervals until a cutting line reaches a straight line connecting a rear edge of said front end plate on said piezo-electric plate and a front edge of said inactive region of said rear end portion.

10. A method as claimed in claim 1 or 2 further comprising the steps of:

forming on an upper surface of said piezo-electric plate an external conductive layer which extends to said front end face of said piezo-electric plate; and forming a conductive film on the front end faces of said piezo-electric plate an said front end plate which electrically connects said conductive material to said external conductive layer.

11. A method as claimed in claim 10 further comprising laminating a plurality of green sheets of ceramic to a predetermined thickness to form said front end plate, and sintering said green sheets.

12. A method as claimed in claim 11 further comprising burying conductive layers in said front end plate.

13. A method as claimed in claim 2, further comprising:

laying first plate forming materials each defining said front end plate and said rear end plate as a single unit onto upper and lower surfaces of the inactive front and rear end portions of said plate in a longitudinal direction thereof;

laying second plate forming materials each defining two side plates as a single unit onto said plate in a lateral direction thereof, said plate forming materials having a width which is approximately two times a width of one of said side plates;

cutting said piezo-electric plate and said first plate forming materials longitudinally along lines which divide said first plate forming materials into said front end plate and said rear end plate; and cutting said piezo-electric plate and said second plate forming materials laterally along lines which substantially divide said second plate forming materials into said side plates.

14. A method as claimed in claim 1 or 2 further comprising laminating a plurality of green sheets of ceramic to a predetermined thickness to form said front end plate, and sintering said green sheets.

* * * * *